US007895986B2

(12) United States Patent
Shimo et al.

(10) Patent No.: US 7,895,986 B2
(45) Date of Patent: Mar. 1, 2011

(54) DIESEL ENGINE AND FUEL INJECTION NOZZLE THEREFOR

(75) Inventors: Daisuke Shimo, Hiroshima (JP); Masahiko Fujimoto, Hiroshima (JP); Motoshi Kataoka, Hiroshima (JP); Sangkyu Kim, Higashihiroshima (JP); Daisuke Fukuda, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 310 days.

(21) Appl. No.: 12/190,463

(22) Filed: Aug. 12, 2008

(65) Prior Publication Data

US 2009/0045269 A1 Feb. 19, 2009

(30) Foreign Application Priority Data

Aug. 14, 2007 (JP) ..... 2007-211323
Mar. 12, 2008 (JP) ..... 2008-063141

(51) Int. Cl.
*F02B 23/02* (2006.01)

(52) U.S. Cl. ..... 123/298; 123/305

(58) Field of Classification Search ..... 123/298, 123/305

See application file for complete search history.

(56) References Cited

U.S. PATENT DOCUMENTS 4,919,093 A 4/1990 Hiraki et al.
6,463,890 B1 * 10/2002 Chomiak ..... 123/25 P
6,513,487 B1 * 2/2003 Jorach et al. ..... 123/299
6,553,960 B1 * 4/2003 Yoshikawa et al. ..... 123/299
7,032,566 B2 * 4/2006 Cavanagh et al. ..... 123/299
7,201,334 B2 4/2007 Sasaki et al.
2005/0120995 A1 * 6/2005 Tsujimoto et al. ..... 123/299

FOREIGN PATENT DOCUMENTS

JP 07167016 7/1995
WO 03/078824 9/2003
WO 2005/078270 8/2005
WO 2006108078 10/2006

OTHER PUBLICATIONS

European Patent Office, International Search Report of EP08014375, Oct. 20, 2008, 1 page.

* cited by examiner

*Primary Examiner*—Erick Solis
(74) *Attorney, Agent, or Firm*—Alleman Hall McCoy Russell & Tuttle LLP

(57) ABSTRACT

A fuel injection nozzle for a diesel engine. The fuel injection nozzle may include a plurality of injection hole groups, each having two injection holes respectively. A distance between the two injection holes, an angle between longitudinal axes of the two injection holes and an angle between horizontal axes of said two injection holes of each injection hole group are each set such that fuel sprays injected from said two injection holes will form a single fuel spray cloud after the fuel sprays collide with a side wall of a combustion chamber formed in a top surface of a piston of the engine, and such that the distance between collision points of the fuel sprays will be in a predetermined range in which a penetration force of said fuel spray cloud along a longitudinal direction of said combustion chamber received after collision with said wall of said combustion chamber is at or near a predetermined maximum value.

7 Claims, 6 Drawing Sheets

DIESEL ENGINE AND FUEL INJECTION NOZZLE THEREFOR

TECHNICAL FIELD

The present description relates to a diesel engine injecting fuel into a combustion chamber formed in a cylinder. More particular, the description pertains to a diesel engine comprising a fuel injection nozzle having a plurality of injection hole groups, each having two injection holes, respectively.

BACKGROUND AND SUMMARY

Some diesel engines have a so-called group hole nozzle (GHN) configured to include a plurality of injection hole groups having a plurality of injection holes for injecting fuel, such that fuel injected by each of the plurality of injection holes will form a single fuel spray cloud by each group, and thereby reduce a radius of each injection hole and atomize fuel while attaining a sufficient total flow cross sectional area of the injection holes by increasing the number of injection holes.

One example of this type of diesel engine is described by U.S. Pat. No. 7,201,334. This reference describes addressing soot (black exhaust) reduction due to enhancement of fuel atomization and strengthening fuel spray penetration by devising an angle between axes of injection holes in each injection hole group.

Using GHN technology, such as the technology described in U.S. Pat. No. 7,201,334 and enhancing fuel atomization can be useful for reducing soot emitted from a diesel engine. However, in some cases engine components such as fuel injection nozzles, combustion chambers, etc., are configured such that a fuel is ignited after the fuel collides with a wall surface of a combustion chamber to increase ignition lag of the injected fuel. In such a case, it is also important to facilitate reheating due to mixing combusted gas and surplus air by strengthening a vertical vortex in the combustion chamber, and to enhance fuel atomization to reduce soot even further, and/or to reduce nitrogen oxide (NOx) sufficiently in addition to reduction of soot.

To strengthen a vertical vortex in the combustion chamber, the penetration force of fuel spray after the fuel collides with a wall surface of a combustion chamber can be increased, which can in turn enhance swirl and penetration longitudinally along the wall surface of fuel spray and combusted gas downstream of a combustion zone, in addition to increasing a penetration force of fuel spray before the fuel reaches the wall surface.

Fuel spray injected into a combustion chamber of a diesel engine may collide with a wall surface of a cavity provided on the top portion of a piston during an ignition lag period and may spread along a wall surface of the cavity by setting the fuel spray penetration properly.

The fuel spray, then, combusts most efficiently near the wall surface, and combustion gas (burned gas) and fuel spray are carried about by a vertical vortex stream induced by a combustion expansion flow, and swirl and penetrate longitudinally along the wall surface.

When the mixture of fuel spray and burned gas swirling and penetrating around the wall surface rapidly reach the center of the cavity, high-temperature burned gas is cooled rapidly by mixing with low-temperature surplus air since there is low-temperature surplus air including plenty of oxygen not used for combustion around the center portion of the cavity. This can result in a decrease in NOx production and a reduction in soot by contacting soot included in burned gas with oxygen and reheating it.

Therefore, by increasing the penetration force of the fuel spray after the fuel spray collides with the wall surface, and by enhancing swirling and penetrating around the wall surface of fuel spray and combusted gas, burned gas can mix with surplus air rapidly, thereby reducing NOx and reheating soot to reduce soot in emissions.

However, the reference described above is designed to maintain spray penetration force by colliding atomized fuel sprays with each other and utilize all air in the combustion chamber space from the injection hole to the combustion chamber wall surface, and thereby complete combustion substantially before the fuel spray reaches the wall surface of the combustion chamber.

So, this reference does not consider enhancement of fuel spray penetration after the fuel spray collides with the wall surface, and therefore it can not enhance penetration force of the fuel spray after the fuel spray collides with the wall surface to reduce generation of NOx and soot sufficiently.

Therefore, there is a need for providing a diesel engine that can enhance penetration force of fuel spray formed from fuel injected into a combustion chamber of engine cylinder after the fuel spay collides with a wall surface of the combustion chamber, to reduce generation of NOx and soot sufficiently.

According to a first aspect of an embodiment of the present description, a diesel engine is disclosed, which comprises a cavity provided on a top surface of a piston of said engine, the cavity having a concave cross section along a moving direction of said piston, and forming a combustion chamber. The engine further may include a fuel injection nozzle located such that the fuel nozzle is facing a substantially center portion of said combustion chamber and is configured to inject fuel to a side wall of said combustion chamber. The concave cross section may have a shape in which a center of a bottom portion is raised up toward an opening of said concave cross section, the center being located along a radial direction of said piston. The fuel injection nozzle may have a plurality of injection hole groups, each group having two injection holes respectively. A distance between said two injection holes and an angle between longitudinal axes of said two injection holes of each of said injection hole groups may be each set such that fuel sprays injected from said two injection holes will form a single fuel spray cloud for each of the injection hole groups after the fuel sprays collide with a wall of said combustion chamber, and such that the distance between collision points of the fuel sprays injected from said two injection holes at a time of their collision with said wall of said combustion chamber will be in a predetermined range in which a penetration force of said fuel spray cloud along a longitudinal direction of said combustion chamber received after collision with said wall of said combustion chamber is at or near a predetermined maximum value.

This diesel engine overcomes at least some of the disadvantages of the approach of the related reference described above.

In one example embodiment, the predetermined range is a range in which said penetration force of said fuel spray cloud along the longitudinal direction of said combustion chamber will be 120% or more as large as a penetration force of said fuel spray cloud along a lateral direction of said combustion chamber.

According to a second aspect of the embodiment of present description, a diesel engine is provided, which comprises a cavity provided on a top surface of a piston of said engine, the top surface having a concave cross section along a moving direction of said piston, and forming a combustion chamber. The engine may further comprise a fuel injection nozzle located such that the fuel nozzle is facing a substantially center portion of said combustion chamber is configured to inject fuel to a side wall of said combustion chamber. The concave cross section may have a shape in which a center of a bottom portion is raised up toward an opening of said concave cross section, the center being located along a radial direction of said piston. The fuel injection nozzle may have a plurality of injection hole groups, each group having two injection holes respectively. A distance between said two injection holes and an angle between longitudinal axes of two injection holes of each of said injection hole groups maybe each set such that fuel sprays injected from said two injection holes will form single fuel spray cloud for each of the injection hole groups after the fuel sprays collide with a wall of said combustion chamber, and such that a distance between collision points of the fuel sprays injected from said two injection holes at a time of their collision with said wall of said combustion chamber will be in a range from 4.5 to 7.5 millimeters.

This diesel engine also overcomes at least some of the disadvantages of the approach of the related reference described above.

In another example embodiment, the distance between respective centers of an outlet of each of said two injection holes in the plane along the moving direction of said piston is in a range from 0.25 to 0.5 millimeters.

In another example embodiment, the distance between respective centers of an outlet of each of said two injection holes in the plane perpendicular to the moving direction of said piston is in a range from 0.25 to 0.5 millimeters.

In another example embodiment, the angle between the respective longitudinal axes of the two injection holes in the plane perpendicular to the moving direction of said piston is in a range from 7.5 to 12.5 degrees.

In another example embodiment, the angle between the respective longitudinal axes of the two injection holes in the plane perpendicular to the moving direction of said piston is in a range from 7.5 to 12.5 degrees.

In this way, at least some of the disadvantages of the related reference described above are overcome.

BRIEF DESCRIPTION OF THE DRAWINGS

FIG. 3A shows a distance Y between the injection holes and an angle $\alpha$ between the injection holes in the longitudinal cross-section of the nozzle, FIG. 3B shows a distance Z between the injection holes and an angle $\beta$ between the injection holes in the lateral cross-section of the nozzle, and FIG. 3C shows a lip radius r of the combustion chamber.

FIG. 6A shows a fuel spray shape of the single injection hole, and FIG. 6B shows a fuel spray shape of the two injection holes.

DETAILED DESCRIPTION

Hereafter, an embodiment of the present invention will be explained based on the appended drawings.

Figure 1:
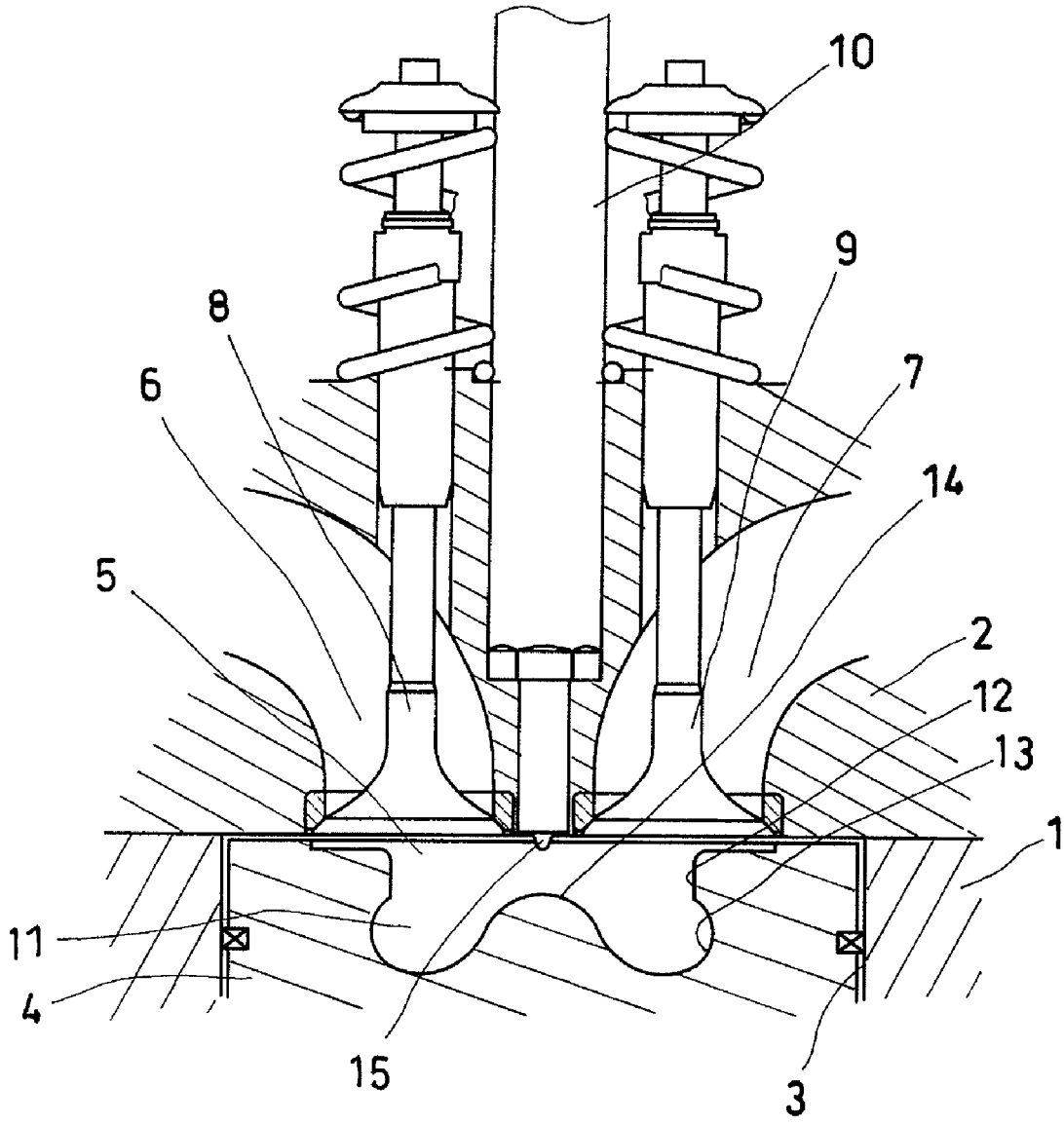
FIG. 1 is a cross-sectional view of a diesel engine in proximity to a combustion chamber according to an embodiment of the present invention.
Figure 2:
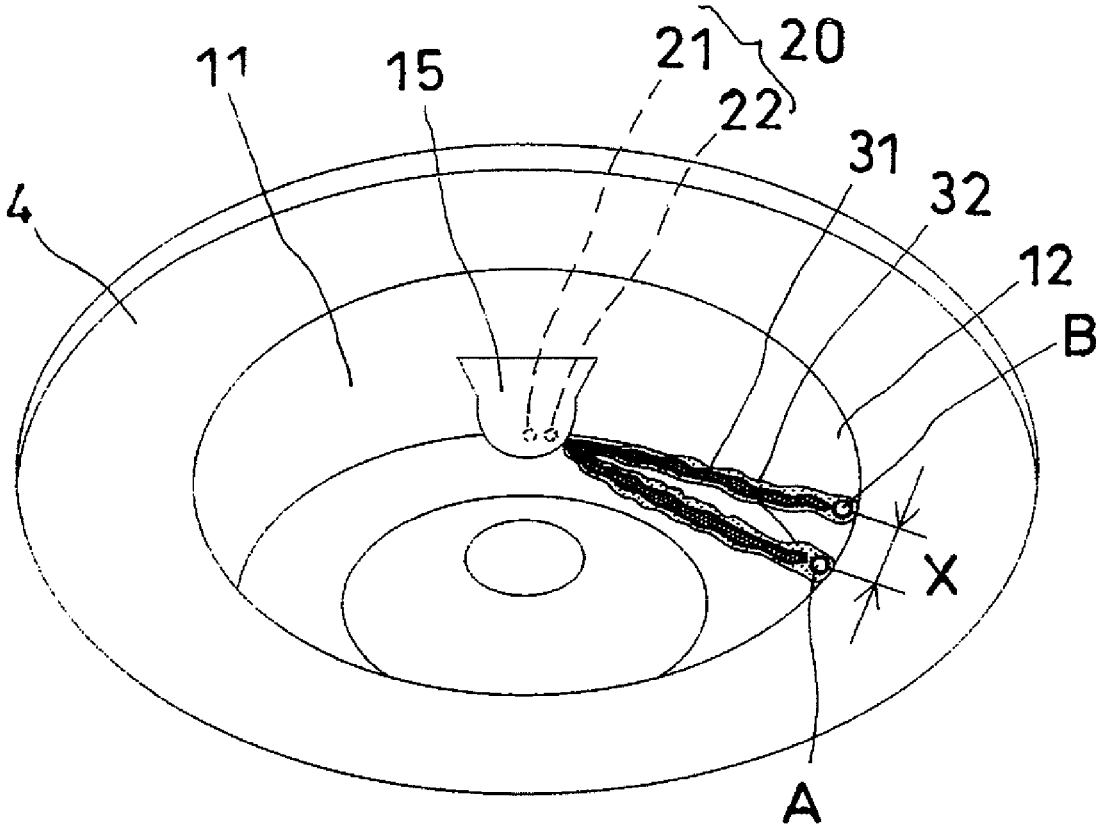
FIG. 2 is a view showing a wall-surface colliding point distance X of the fuel sprays in the diesel engine shown in FIG. 1.
Figure 3A:
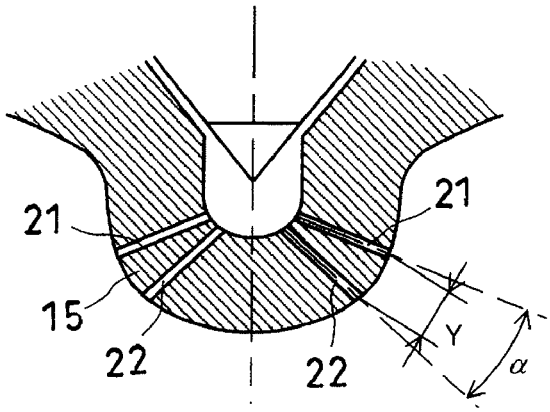
FIGS. 3A-3C are views showing parameters of a layout of the fuel-injection nozzle holes shown in FIG. 2.
Figure 3B:
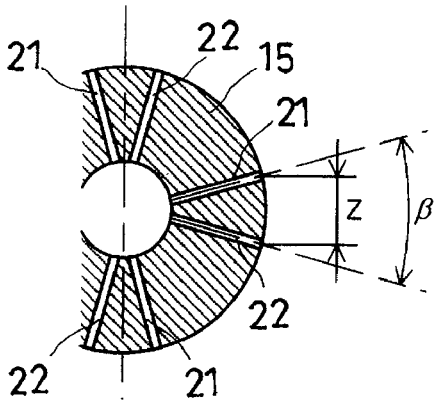
Figure 3C:
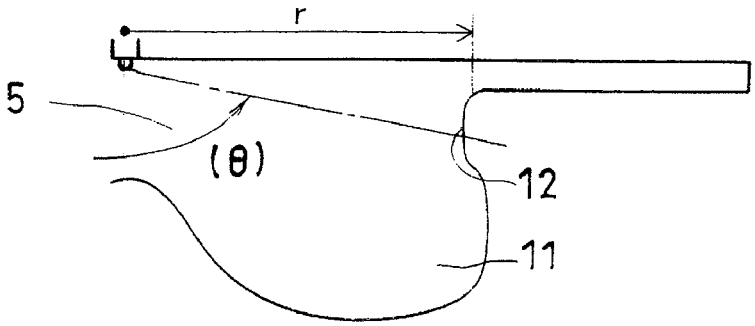
Figure 4:
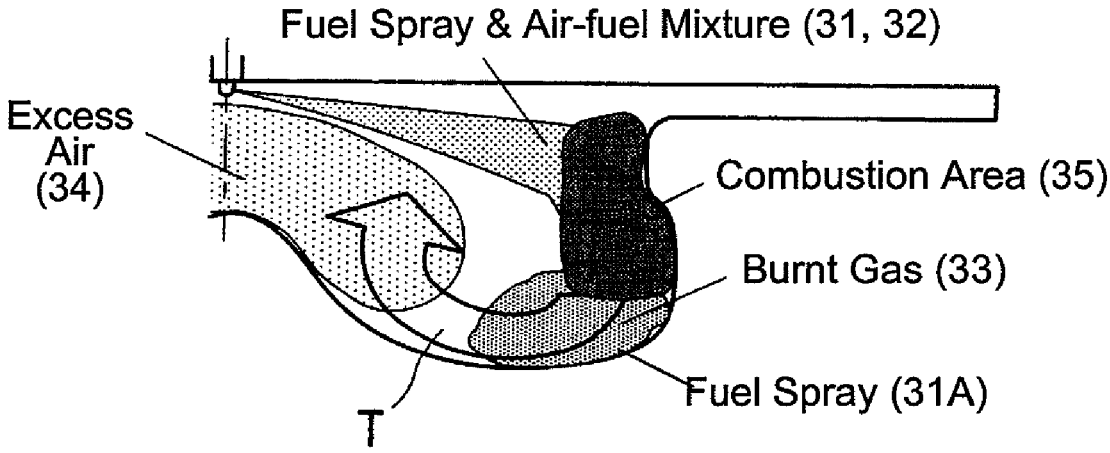
FIG. 4 is a view showing a penetration force after the fuel spray injected from the fuel injection nozzle shown in FIG. 2 collides with the wall-surface.
Figure 5:
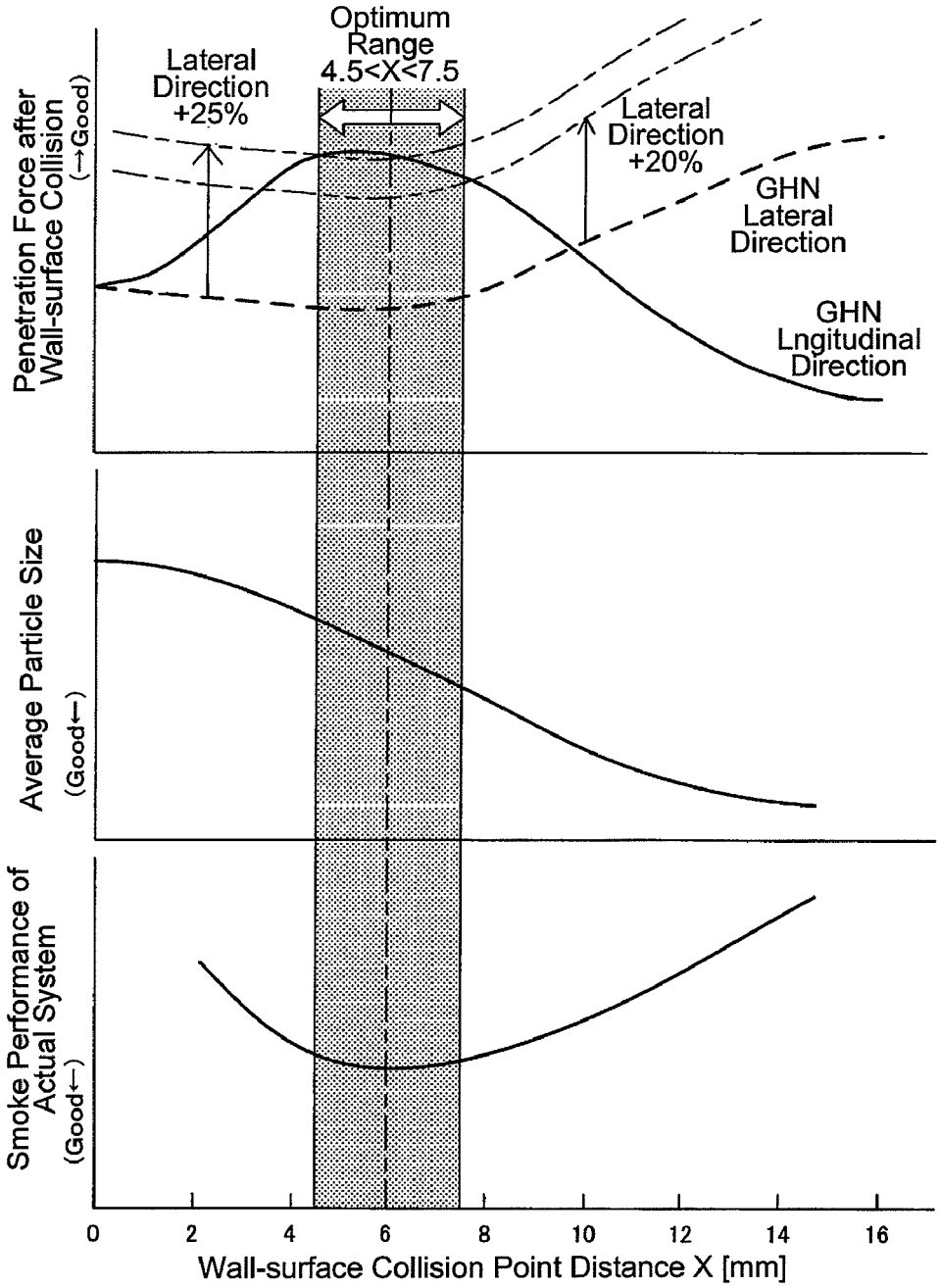
FIG. 5 shows graphs illustrating relationships between the wall-surface colliding point distance X of the fuel sprays injected from the fuel injection nozzle shown in FIG. 2, and the penetration force after the wall-surface collision and an average particle diameter of the fuel sprays and a smoke performance.

FIGS. 1-5 show an embodiment of the present invention. FIG. 1 is a cross-sectional view of a diesel engine in proximity to a combustion chamber according to this embodiment. FIG. 2 shows a wall-surface colliding point distance X of fuel sprays 2 (described later). FIGS. 3A-3C show layout parameters of fuel-injection nozzle holes. Specifically, FIG. 3A shows a distance Y between the injection holes and an angle $\alpha$ between the injection holes in the longitudinal cross-section of the nozzles. FIG. 3B shows a distance Z between the injection holes and an angle $\beta$ between the injection holes in the lateral cross-section of the nozzles. FIG. 3C shows a lip radius "r" of the combustion chamber. FIG. 4 shows a penetration force after fuel spray clouds collide a wall surface of the combustion chamber. FIG. 5 is a graph showing a relationship between the wall-surface colliding point distance X of the fuel sprays, and the penetration force after the wall-surface collision and an average particle diameter of the fuel spray and smoke performance.

In this embodiment, the diesel engine is an in-line multi-cylinder engine. As shown in FIG. 1, a cylinder head 2 typically is arranged above the cylinder block 1. Each piston 4 is arranged so as to move in the up-and-down direction inside a cylinder bore 3 of each of the engine cylinders formed in the cylinder block 1. Each combustion chamber 5 typically is defined by the cylinder head 2, the cylinder bore 3, and the piston 4. An air-intake port (e.g., helical port) 6 of a swirl production type, and an exhaust port 7 are formed in the cylinder head 2 for each cylinder. An air-intake valve 8 and an exhaust valve 9 are also disposed in the cylinder head 2 to open and close the air-intake port 6 and the exhaust port 7, respectively.

A fuel-injection valve 10 is attached to the cylinder head 2 so that it is facing a substantially center portion of the combustion chamber 5 of each cylinder. In this embodiment, the cylinder head 2 is a flat type, and the air-intake valves 8 and the exhaust valves 9 are vertical types. A reentrant-type cavity 11 is formed in a top surface of the piston 4 so that it is recessed in the moving direction of the piston (i.e., in the up-and-down direction in FIG. 1), and its diameter is smaller at its opening than that of a deeper or lower side.

In this embodiment, the cavity 11 forms the combustion chamber 5. An opening portion of the cavity 11 in proximity to the top surface of the piston 4 protrudes inwardly in the radial direction of the piston to form an annular lip portion 12. Another portion of the cavity 11 located below the lip portion 12 is recessed outwardly in the radial direction of the piston to form an annular recessed portion 13. A portion of the cavity 11 located at the bottom of the cavity 11 and in the center in the radial direction of the piston forms a convex portion 14 that protrudes toward the opening of the cavity 11.

A tip-end portion of the fuel-injection valve 10 constitutes a fuel injection nozzle 15. In this embodiment, the fuel injection nozzle 15 slightly protrudes into the combustion chamber 5 to carry out direct injection of fuel into the cavity 11 on the top surface of the piston 4.

A plurality of injection hole groups 20 (see FIG. 2) are arranged in the fuel injection nozzle 15 so as to be approximately equally spaced in the circumferential direction (in FIG. 2, only one group is shown). Each injection hole group 20 includes two injection holes 21 and 22. The injection hole groups 20 may be 5 to 12 groups, for example.

From the injection holes 21 and 22 of each injection hole group 20, fuel is injected slightly downward to a wall surface of the lip portion 12 of the cavity 11. When the fuel sprays injected from the two injection holes 21 and 22 of each injection hole group 20 collide with the wall surface of the combustion chamber (i.e., wall surface of the cavity 11), the fuel sprays 31 forms or are integrated into a single fuel spray cloud for each injection hole group 20. As shown in FIG. 2, the two injection holes 21 and 22 are configured so that a distance between two colliding positions (colliding points A and B, respectively) of the fuel sprays injected from the two injection holes 21 and 22 (i.e., wall-surface colliding point distance X) may be within a range of 4.5 to 7.5 mm.

Fundamentally, the wall-surface colliding point distance X may be set according to a distance between longitudinal centers of the two injection holes 21 and 22 and an angle between the longitudinal canters of the injection holes, and a distance from the injection holes to the colliding positions on the wall surface of the combustion chamber. Here, the distance between the injection holes may be defined three-dimensionally by a distance Y between exits of the injection holes in the longitudinal cross-section of the nozzles as shown in FIG. 3A, and a distance Z between exits of the injection holes in the lateral cross-section of the nozzles as shown in FIG. 3B. Further, the angle between the injection holes may be defined by an angle $\alpha$ between the injection holes in the longitudinal cross-section of the nozzles as shown in FIG. 3A and an angle $\beta$ between the injection holes in the lateral cross-section of the nozzles as shown in FIG. 3B. Further, the distance from the nozzle holes to the colliding positions on the wall surface of the combustion chamber may be defined by the combustion chamber lip radius "r" as shown in FIG. 3C.

Thus, an equation to find the wall-surface colliding point distance X may be as follows.

$$X=2*r*\tan(\tan^{-1}((\sqrt{\tan^2\alpha+\tan^2\beta})/2+\sqrt{Y^2+Z^2}))$$

Here, the setting ranges of the nozzle parameters described above may be $0.25<Y<0.5$ mm; $0.25<Z<0.5$ mm; $0<\alpha<5$ deg; $7.5<\beta<12.5$ deg; $145<\theta<160$ deg; and $24/43<(r/\text{bore radius})<35/43$, for example. Here, $\theta$ is an injection hole corn angle.

As shown in FIG. 4, the fuel sprays 31 injected into the combustion chamber 5 collide with the wall surface of the cavity 11 during an ignition delay period, and then spread along the wall surface while mixed with an air 32. Then, the fuel spray 31 combusts in proximity to the collided wall surface. Then, the fuel spray 31A after the wall-surface collision and burned gas 33 ride a longitudinal vortex stream caused by an expanding flow due to the combustion, and flow in the longitudinal direction of the piston (i.e., the moving direction of the piston) along the wall surface and then the lower bottom of the cavity 11 (see an arrow T). If this turning flow of the fuel spray is strong in the longitudinal direction, the fuel spray 31A and the burned gas 33 quickly reach to the center portion of the cavity 11.

In proximity to the center portion of the cavity 11, surplus air 34 of low temperature that contains a great amount of oxygen that has not been used for the combustion typically exists. If a penetration force of the fuel spray 31A after the wall-surface collision and the burned gas 33 in the longitudinal direction is large, the turning flow of the fuel spray 31A and the burned gas 33 downstream of a combustion area 35 turns upwardly to the longitudinal direction. This allows the surplus air 34 to quickly mix with the burned gas 33 to rapidly cool the burned gas 33 to reduce production of NOx. In addition, soot in the burned gas 33 is stimulated to re-combust, thereby reducing NOx and smoke that will be discharged.

As described above, for the fuel injection nozzle 15 of this embodiment, the two injection holes 21 and 22 of each injection hole group 20 is configured so that the wall-surface colliding point distance X may be set to 4.5 to 7.5 mm. In this setting, the penetration force in the longitudinal direction after the fuel sprays collide with the wall surface is powerful and, thus, atomization of the fuel can also be stimulated.

As a result, in this embodiment, the fuel atomization can be stimulated, and the penetration force after the fuel sprays collide with the wall surface can be enhanced. Further, the turning flow of the fuel sprays and the burned gas downstream of the combustion area in the longitudinal direction can be enhanced. Further, the burned gas 33 can be quickly mixed with the surplus air 34. Further, the burned gas 33 can be rapidly cooled to reduce the production of NOx, and the re-combustion of soot in the burned gas 33 can be stimulated, thereby sufficiently reducing the production of NOx and soot.

FIG. 5 shows a numerical analysis of performance of the fuel injection nozzle 15. In FIG. 5, the horizontal axis of each graph represents the wall-surface colliding point distance X, and the vertical axis represents the penetration force after the wall-surface collision in the upper graph, an average particle diameter in the middle graph, and a smoke performance by the experimental data with an actual system in the lower graph.

In the upper graph of FIG. 5, a thick solid line shows the penetration force after the wall-surface collision in the longitudinal direction of the combustion chamber (a unit for "length" such as "millimeter(s)" may be used), and a thicker dashed line shows the penetration force after the wall-surface collision in the lateral direction of the combustion chamber. A two-dot chain line in this graph shows a curve of 1.2 times (+20%) of the thick dashed line, and a dot chain line shows 1.25 times (+25%).

As shown in FIG. 5, the spray particle size after the fuel sprays injected from the two injection holes collide with the wall surface becomes smaller as the wall-surface colliding point distance X becomes greater. On the other hand, the penetration force in the longitudinal direction of the combustion chamber after the wall-surface collision may have a range of wall-surface colliding point distances where the penetration force becomes larger, although the penetration force typically decreases in for distances outside of this range. Thus, a predetermined range of the wall-surface colliding point distance X where the penetration force after the wall-surface collision in the longitudinal direction of the combustion chamber is maintained at substantially a predetermined maximum value is set to be the optimum range. By maintaining the penetration force within the range, the penetration force after the wall-surface collision can be maintained within a range where the fuel atomization can be stimulated, as well as the penetration force after the wall-surface collision is enhanced. The middle graph of FIG. 5 shows a degree of the atomization of the fuel sprays in an average particle diameter after 1 millisecond of the injection.

The predetermined range (optimum range) may be a range where the wall-surface colliding point distance X is 4.5 to 7.5 mm, as shown in FIG. 5. Within the optimum range, the penetration force in the longitudinal direction of the combustion chamber is at least 20% larger than that in the lateral direction of the combustion chamber. At the lower limit of 4.5 mm, the penetration force in the longitudinal direction of the combustion chamber is 25% larger than that in the lateral direction of the combustion chamber that is perpendicular to the moving direction of the piston and is in the circumferential direction of the combustion chamber. On the other hand, at the higher limit of 7.5 mm, the penetration force in the longitudinal direction of the combustion chamber is 20% larger than that in the lateral direction of the combustion chamber.

Because the average particle diameter is smaller on the upper limit side than on the lower limit side, the upper limit side is more advantageous for emission control. Therefore, the wall-surface colliding point distance X where the penetration force in the longitudinal direction of the combustion chamber is 20% larger than the penetration force in the lateral direction of the combustion chamber may be set to be a threshold. Also in the illustrated test data of the actual system (i.e., smoke performance of the system), a discharge amount of soot (smoke) is low enough within the limit where the distance X between the colliding points is 4.5 to 7.5 mm. As shown in the lower graph of FIG. 5, a filter smoke number (FSN) may be used as a unit for the vertical axis of the system smoke performance, for example.

Figure 6A:
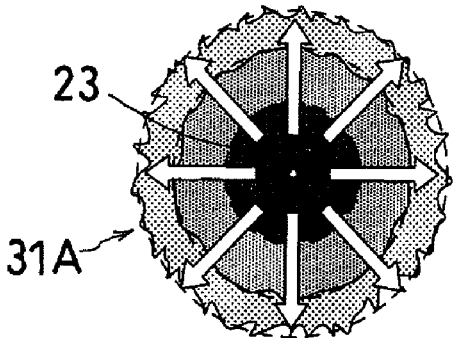
FIGS. 6A and 6B show measured spray shapes after the wall-surface collision at the time of injecting the fuel onto the wall surface where a single injection hole and two injection holes are equipped, in connection with the penetration force after the fuel sprays collided with the wall-surface, where
Figure 6B:
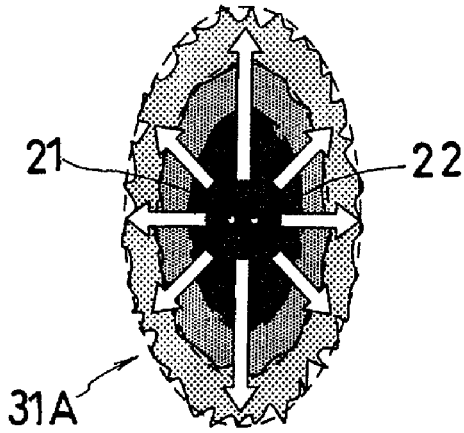

For the penetration force after the fuel spray collided the wall surface in the diesel engine of this embodiment, FIGS. 6A and 6B schematically show measurements of spray shapes after the injected fuel collides the wall surface. FIG. 6A shows a spray shape from a single injection hole, FIG. 6B shows a spray shape from two injection holes.

As shown in FIG. 6A, when the fuel spray 31 is injected from a single injection hole 23 to collide with the wall surface, the spray after 31A the collision spreads in the shape of a concentric circle. However, as described in this embodiment, when two injection holes 21 and 22 are arranged adjacent to each other with a moderate distance therebetween, and the fuel sprays 31 injected from the two injection holes 21 and 22 collide with the wall surface of the cavity 11. A spread of the spray 31A after the collision is amplified in the direction perpendicular to the arrangement direction of the injection holes 21 and 22 to be in the shape of an ellipse as shown in FIG. 6B. Using this characteristic, the penetration force after the wall-surface collision can be enhanced and, thereby, enhancing the turning flow of the fuel spray 31A after the wall-surface collision and the burned gas 33 in the longitudinal direction.

As described above, the diesel engine of this embodiment includes a cavity that is provided in the top of the piston so as to be located in the center portion of the piston, has a concave cross-section in the moving direction of the piston, and forms a combustion chamber. The diesel engine further includes a fuel injection nozzle that is provided at a position facing the substantially center portion of the combustion chamber, and injects fuel towards the wall surface of the combustion chamber. The concave cross-section has a shape where a bottom center portion of the piston located in the center in the radial direction of the piston protrudes toward an opening of the cavity. The fuel injection nozzle has a plurality of injection hole groups, each of which have two injection holes. A distance and an angle between the two injection holes of each injection hole group are set so that the fuel sprays injected from the two injection holes form a single fuel spray cloud when they collide with the wall surface of the combustion chamber, and a distance between colliding points when the fuel sprays injected from the two injection holes collide with the wall surface of the combustion chamber falls in a predetermined range where a penetration force in the longitudinal direction of the combustion chamber obtained after the collision with the wall surface of the combustion chamber maintains substantially a predetermined maximum value (for example, a range of 4.5 to 7.5 mm).

When injecting fuel towards the wall surface of the combustion chamber from an upper portion of the center portion of the combustion chamber, combustion of the fuel spray in a combustion area downstream tends not to be stimulated in the proximity of the center portion of the combustion chamber located below the fuel injection nozzle comparing with an area in proximity to the wall surface of the combustion chamber, with surplus air being easily remained.

Therefore, the fuel injection nozzle is configured as described above so as to stimulate the fuel atomization, while enhancing the penetration force in the longitudinal direction of the combustion chamber after the wall-surface collision. Thus, the turning flow of the fuel spray downstream of the combustion area and the burned gas in the longitudinal direction can be enhanced, and the fuel spray and the burned gas reach in proximity to the canter of the combustion chamber below the fuel injection nozzle along the wall surface of the combustion chamber. As a result, the burned gas can be quickly mixed with the surplus air, and the production of NOx can be reduced by rapidly cooling the burned gas. Further, re-combustion of the soot in the burned gas can be stimulated, and production of NOx and soot can be reduced.

For the fuel sprays injected from two injection holes, the spray particle size after the wall-surface collision becomes simply smaller as the distance between colliding points when the injected fuel sprays collide with the wall surface of the combustion chamber (i.e., wall-surface colliding point distance) becomes larger. On the other hand, the penetration force in the longitudinal direction of the combustion chamber after the wall-surface collision has a range of the wall-surface colliding point distance within which the penetration force is larger, and the penetration force simply decreases outside the range. The characteristics of the atomization of the fuel sprays and the penetration force in the longitudinal direction of the combustion chamber after the wall-surface collision, do not depend on the size of the combustion chamber, but are uniquely defined based on the wall-surface colliding point distance. Therefore, if the wall-surface colliding point distance is maintained within the range where the penetration force after the wall-surface collision in the longitudinal direction of the combustion chamber maintains at approximately the predetermined maximum value, the penetration force can be enhanced, while atomization can be stimulated. The wall-surface colliding point distance may fundamentally be defined based on the settings of the distance between the two injection holes, the angle between the injection holes, and the shape of the combustion chamber (that is, the distance from the injection nozzles to the colliding points on the wall surface of the combustion chamber).

The predetermined range where the penetration force in the longitudinal direction of the combustion chamber is maintained approximately at a predetermined maximum value may be a range where the penetration force in the longitudinal direction of the combustion chamber is at least 20% larger than the penetration force in the lateral direction of the combustion chamber, for example.

It will be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A diesel engine comprising:

a cavity provided on a top surface of a piston of said engine, the cavity having a concave cross section along a moving direction of said piston, and forming a combustion chamber; and a fuel injection nozzle located such that the fuel injection nozzle is facing a substantially center portion of said combustion chamber and is configured to inject fuel to a side wall of said combustion chamber;

wherein said concave cross section has a shape in which a center of a bottom portion is raised up toward an opening of said concave cross section, the center being located along a radial direction of said piston:

wherein said fuel injection nozzle has a plurality of injection hole groups, each group having two injection holes respectively;

wherein a distance between said two injection holes, an angle between longitudinal axes of said two injection holes and an angle between horizontal axes of said two injection holes of each of said injection hole groups are each set such that fuel sprays injected from said two injection holes will form a single fuel spray cloud for each of the injection hole groups after the fuel sprays collide with a wall of said combustion chamber, and such that the distance between collision points of the fuel sprays injected from said two injection holes at a time of their collision with said wall of said combustion chamber will be in a predetermined range in which a penetration force of said fuel spray cloud along a longitudinal direction of said combustion chamber received after collision with said wall of said combustion chamber is at or near a predetermined maximum value; and wherein said predetermined range is a range in which said penetration force of said fuel spray cloud along the longitudinal direction of said combustion chamber will be 120% or more as large as a penetration force of said fuel spray cloud along a lateral direction of said combustion chamber.

2. A diesel engine comprising:

a cavity provided on a top surface of a piston of said engine, the top surface having a concave cross section along a moving direction of said piston, and forming a combustion chamber; and a fuel injection nozzle located such that the fuel injection nozzle is facing a substantially center portion of said combustion chamber is configured to inject fuel to a side wall of said combustion chamber;

wherein said concave cross section has a shape in which a center of a bottom portion is raised up toward an opening of said concave cross section, the center being located along a radial direction of said piston;

wherein said fuel injection nozzle has a plurality of injection hole groups, each group having two injection holes respectively;

wherein a distance between said two injection holes, an angle between longitudinal axes of two injection holes and an angle between horizontal axes of said two injection holes of each of said injection hole groups are each set such that fuel sprays injected from said two injection holes will form single fuel spray cloud for each of the injection hole groups after the fuel sprays collide with a wall of said combustion chamber, and such that a distance between collision points of the fuel sprays injected from said two injection holes at a time of their collision with said wall of said combustion chamber will be in a range from 4.5 to 7.5 millimeters.

3. The diesel engine as described in claim 2, wherein the distance between respective centers of an outlet of each of said two injection holes in the plane along the moving direction of said piston is in a range from 0.25 to 0.5 millimeters.

4. The diesel engine as described in claim 2, wherein the distance between respective centers of an outlet of each of said two injection holes in the plane perpendicular to the moving direction of said piston is in a range from 0.25 to 0.5 millimeters.

5. The diesel engine as described in claim 2, wherein the angle between the respective longitudinal axes of the two injection holes in the plane along the moving direction of said piston is in a range from 0 to 5 degrees.

6. The diesel engine as described in claim 2, wherein the angle between the respective longitudinal axes of the two injection holes in the plane perpendicular to the moving direction of said piston is in a range from 7.5 to 12.5 degrees.

7. A fuel injection nozzle for a diesel engine, the fuel injection nozzle comprising:

a plurality of injection hole groups, each group having two injection holes respectively;

wherein a distance between said two injection holes, an angle between longitudinal axes of said two injection holes and an angle between horizontal axes of said two injection holes of each of said injection hole groups are each set such that fuel sprays injected from said two injection holes will form a single fuel spray cloud for each of the injection hole groups after the fuel sprays collide with a side wall of a combustion chamber formed in a top surface of a piston of the engine, and such that the distance between collision points of the fuel sprays injected from said two injection holes at a time of their collision with said wall of said combustion chamber will be in a predetermined range in which a penetration force of said fuel spray cloud along a longitudinal direction of said combustion chamber received after collision with said wall of said combustion chamber is at or near a predetermined maximum value; and wherein said predetermined range is a range in which said penetration force of said fuel spray cloud along the longitudinal direction of said combustion chamber will be 120% or more as large as a penetration force of said fuel spray cloud along a lateral direction of said combustion chamber.

* * * * *